US010509348B2

(12) United States Patent
Okuno

(10) Patent No.: US 10,509,348 B2
(45) Date of Patent: Dec. 17, 2019

(54) FIXING DEVICE, IMAGE FORMING APPARATUS, AND CONTROL METHOD

(71) Applicant: Konica Minolta, Inc., Tokyo (JP)

(72) Inventor: Jinju Okuno, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/212,009

(22) Filed: Dec. 6, 2018

(65) Prior Publication Data

US 2019/0219954 A1 Jul. 18, 2019

(30) Foreign Application Priority Data

Jan. 12, 2018 (JP) ..... 2018-003581

(51) Int. Cl.
*G03G 15/20* (2006.01)

(52) U.S. Cl.
CPC ..... *G03G 15/205* (2013.01); *G03G 15/2025* (2013.01)

(58) Field of Classification Search
CPC ..... G03G 15/205; G03G 15/2025
See application file for complete search history.

(56) References Cited

U.S. PATENT DOCUMENTS

2012/0251208 A1* 10/2012 Hasegawa ..... G03G 15/2017 399/329
2013/0084094 A1* 4/2013 Tamura ..... G03G 15/205 399/70
2013/0272736 A1* 10/2013 Sakamaki ..... G03G 15/205 399/67

FOREIGN PATENT DOCUMENTS

JP 2009205067 A 9/2009

* cited by examiner

*Primary Examiner* — Sandra Brase
(74) *Attorney, Agent, or Firm* — Lucas & Mercanti, LLP

(57) ABSTRACT

A fixing device fixes a toner image to a paper sheet, and the fixing device includes: a pressure roller; and a heating member, wherein the heating member includes: a pressure pad; a heating roller including a heater; and a fixing belt, the fixing device further includes a drive mechanism that controls rotation of the pressure roller and the heating roller, the fixing belt is driven while sliding on a surface of the pressure pad, when the heating roller rotates, and the drive mechanism applies pressure to the paper sheet, fixes the toner image to the paper sheet, switches between a contact state in which the pressure roller and the fixing belt are in contact with each other, and a separated state in which the pressure roller and the fixing belt are separated from each other, and switches to the contact state when a predetermined condition is satisfied.

17 Claims, 10 Drawing Sheets

FIXING DEVICE, IMAGE FORMING APPARATUS, AND CONTROL METHOD

The entire disclosure of Japanese patent Application No. 2018-003581, filed on Jan. 12, 2018, is incorporated herein by reference in its entirety.

BACKGROUND

Technological Field

The present disclosure relates to an image forming apparatus, and more particularly, to a fixing device included in an image forming apparatus.

Description of the Related Art

Electrophotographic image forming apparatuses are widely used today. An electrophotographic image forming apparatus performs a printing process that includes a process of forming a toner image corresponding to an input image on a photosensitive member, a process of transferring the toner image from the photosensitive member onto a transfer belt as the primary transfer process, a process of transferring the toner image from the transfer belt onto a paper sheet as the secondary transfer process, and a process of thermally fixing the toner image to the paper sheet with a fixing device.

In the fixing process with the fixing device, the paper sheet having the toner image formed thereon is made to pass through the contact region between a pressure roller and a heating member. The heating member includes a heating roller including a heater and a fixing belt wound around the heating roller in an endless manner. The fixing belt is driven to transmit the heat from the heater to the contact region, to apply heat and pressure to the passing paper sheet, and fix the toner image formed on the paper sheet to the paper sheet.

To save energy, a fixing unit these days normally includes a heating member that is a pad portion having a small heat capacity and a large contact portion with the pressure roller. A lubricant for allowing the fixing belt to slide is applied to the surface of the pad portion.

As an example of a technique relating to such a fixing device, JP 2009-205067 A discloses a fixing device in which the heating member and the pressure roller each have a drive unit, and the heating member is warmed up while being separated from the pressure roller, so that heat transfer to the pressure roller is prevented, and the warm-up time is shortened.

According to the technique disclosed in JP 2009-205067 A, however, the viscosity of the lubricant applied to the sliding portion between the pad portion and the fixing belt becomes higher as the temperature becomes lower. Therefore, in a low-temperature environment, the fixing belt adheres to the pad portion, and the fixing belt cannot be driven at a start of warm-up.

Further, in some cases where an image forming apparatus has not been used for a long period of time, the fixing belt deforms to have a shape to match the shape of the pad portion, and as a result, the fixing belt cannot be driven. Therefore, there is a demand for a fixing device that can operate without depending on usage environments and usage conditions.

SUMMARY

The present disclosure has been made to solve the above problems, and an object of an aspect of the present disclosure is to provide a fixing device that can operate without depending on usage environments and usage conditions.

To achieve the abovementioned object, according to an aspect of the present invention, there is provided a fixing device that fixes a toner image formed on a paper sheet to the paper sheet, and the fixing device reflecting one aspect of the present invention comprises: a pressure roller that applies pressure to the paper sheet; and a heating member that heats the paper sheet, wherein the heating member includes: a pressure pad positioned to face the pressure roller; a heating roller including a heater; and a fixing belt wound around the pressure pad and the heating roller in an endless manner, the fixing device further comprises a drive mechanism that controls rotation of the pressure roller and the heating roller, the fixing belt is driven while sliding on a surface of the pressure pad, when the heating roller rotates, and the drive mechanism moves at least one of the pressure roller and the heating member, to apply pressure to the paper sheet being conveyed between the pressure roller and the pressure pad, and fix the toner image to the paper sheet, switches between a contact state in which the pressure roller and the fixing belt are in contact with each other, and a separated state in which the pressure roller and the fixing belt are separated from each other, and switches to the contact state when a predetermined condition is satisfied during a period of warm-up for the heating member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
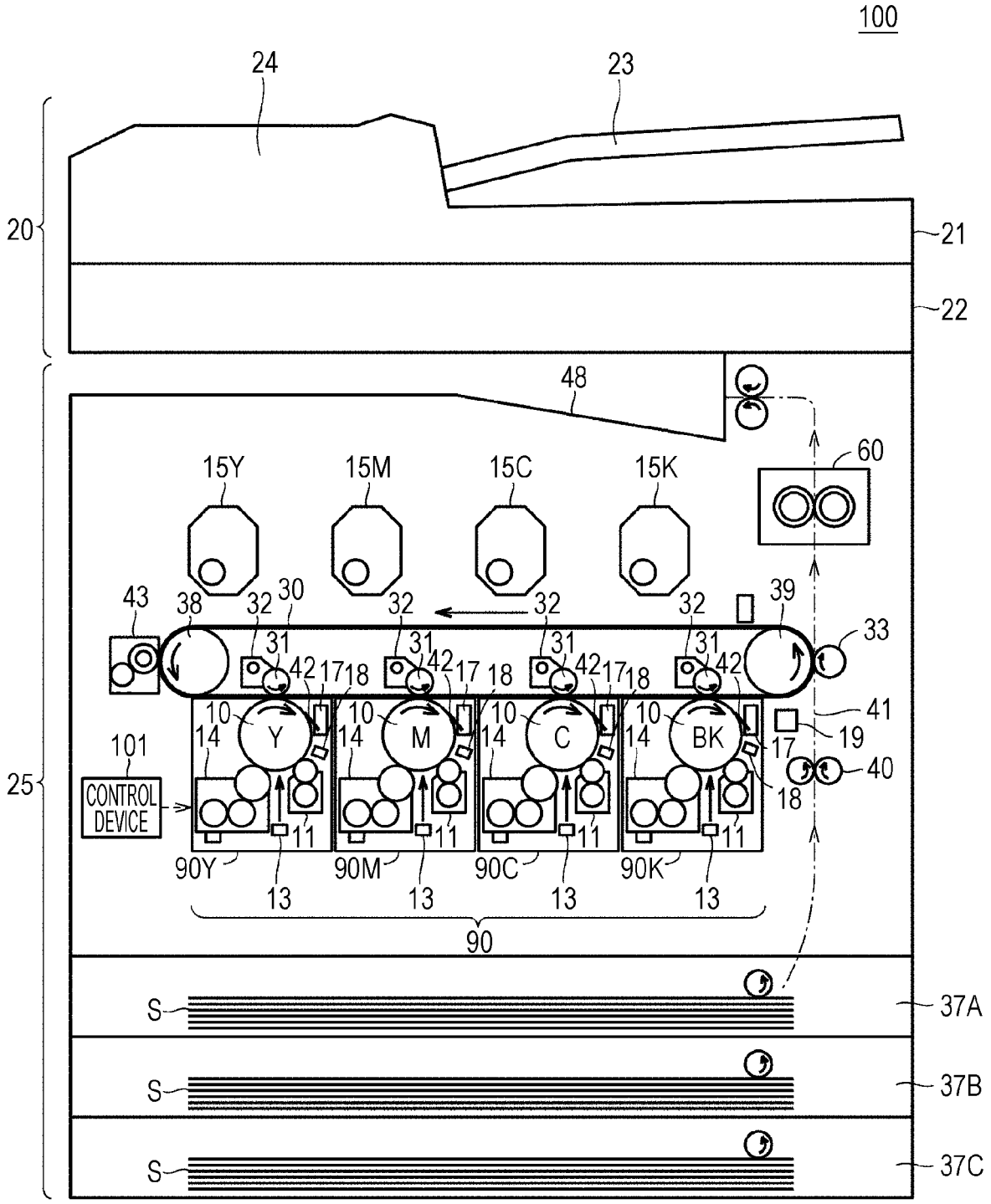
FIG. 1 is a diagram showing an example structure of an entire image forming apparatus.

Hereinafter, one or more embodiments of the present invention will be described with reference to the drawings. However, the scope of the invention is not limited to the disclosed embodiments. In the description below, like components and constituent elements are denoted by like reference numerals. Like components and constituent elements also have like names and functions. Therefore, detailed explanation of them will not be unnecessarily repeated. It should be noted that the embodiments and the modifications described below may be selectively combined as appropriate.

First Embodiment

[1. Structure of an Image Forming Apparatus 100]

Referring to FIG. 1, an image forming apparatus 100 according to a first embodiment is described. FIG. 1 is a diagram showing an example structure of the entire image forming apparatus 100.

The image forming apparatus 100 as a color printer is shown in FIG. 1. Although the image forming apparatus 100 as a color printer will be described below, the image forming apparatus 100 is not necessarily a color printer. For example, the image forming apparatus 100 may be a monochrome printer, or may be a multifunctional peripheral (MFP) that functions as a monochrome printer, a color printer, and a facsimile machine.

The image forming apparatus 100 includes a scanner 20 as an image reading unit, and a printer 25 including image forming units 90 (specifically, image forming units 90Y, 90M, 90C, and 90K). The scanner 20 includes a cover 21, a platen 22, and an auto document feeder (ADF) 24. One end of the cover 21 is secured to the platen 22, and the cover 21 can be opened and closed, with the one end being the support.

A user of the image forming apparatus 100 can set a document on the platen 22 by opening the cover 21. In a case where a document is already set on the platen 22, the image forming apparatus 100 starts scanning the document set on the platen 22 when receiving a scan instruction. In a case where documents are set in a sheet tray 37, the image forming apparatus 100 automatically reads the documents one by one with the ADF 24 when receiving a scan instruction.

The printer 25 includes the image forming units 90Y, 90M, 90C, and 90K, an image density control (IDC) sensor 19, a transfer belt 30, primary transfer rollers 31, transfer drives 32, a secondary transfer roller 33, sheet trays 37 (specifically, sheet trays 37A, 37B, and 37C), a driven roller 38, a driving roller 39, registration rollers 40, a cleaning unit 43, a fixing unit 60, and a control device 101.

The image forming units 90Y, 90M, 90C, and 90K are sequentially arranged along the transfer belt 30. The image forming unit 90Y receives a supply of toner from a toner bottle 15Y, and forms a yellow (Y) toner image. The image forming unit 90M receives a supply of toner from a toner bottle 15M, and forms a magenta (M) toner image. The image forming unit 90C receives a supply of toner from a toner bottle 15C, and forms a cyan (C) toner image. The image forming unit 90K receives a supply of toner from a toner bottle 15K, and forms a black (BK) toner image.

The image forming units 90Y, 90M, 90C, and 90K are arranged along the transfer belt 30 in the direction of rotation of the transfer belt 30. That is, in the image formation path on the transfer belt 30, the image forming unit 90Y is disposed at the most upstream position, followed by the image forming units 90M and 90C, and the image forming unit 90K is disposed at the most downstream position. The image forming units 90Y, 90M, 90C, and 90K each include a photosensitive member 10 designed to be rotatable, a charging member 11, an exposure device 13, a developing device 14, a cleaning unit 17, and a neutralization device 18.

After the respective image forming units 90Y, 90M, 90C, and 90K operate as described above, the transfer drives 32 sequentially transfer a yellow (Y) toner image, a magenta (M) toner image, a cyan (C) toner image, and a black (BK) toner image from the photosensitive members 10 onto the transfer belt 30 in a superimposed manner. As a result, a color toner image is formed on the transfer belt 30.

The IDC sensor 19 detects the density of each toner image formed on the transfer belt 30. Typically, the IDC sensor 19 is a light intensity sensor formed with a reflective photosensor, and detects the intensity of light reflected from the surface of the transfer belt 30.

The primary transfer rollers 31 are formed with metal rollers, for example. The primary transfer rollers 31 may be formed with elastic rollers, or may be formed with sheet-like members such as elastic sheets. For example, the elastic rollers or elastic sheets may be made of thermoplastic elastomer such as rubber. As will be described later in detail, the primary transfer rollers 31 transfer the toner on the photosensitive members 10 onto the transfer belt 30, as a transfer voltage is applied to the primary transfer rollers 31.

The transfer belt 30 is stretched around the driven roller 38 and the driving roller 39. The driving roller 39 is connected to a motor (not shown). As the control device 101 controls the motor, the driving roller 39 rotates. The transfer belt 30 and the driven roller 38 rotate with the driving roller 39. As a result, the toner image 35 on the transfer belt 30 is conveyed to the secondary transfer roller 33.

In each of the sheet trays 37A, 37B, and 37C, paper sheets of different sizes or types are set, for example. The paper sheets are conveyed one by one from the sheet feed tray selected from among the sheet trays 37A, 37B, and 37C, to the conveyance path 41. Each paper sheet is sent to the secondary transfer roller 33 by the registration rollers 40.

In time with the sending of each paper sheet, the control device 101 controls the transfer voltage to be applied to the secondary transfer roller 33. The secondary transfer roller 33 applies a transfer voltage of the opposite polarity of the polarity of the charged toner image, to the paper sheet being conveyed. As a result, the toner image is attracted to the secondary transfer roller 33 from the transfer belt 30. Thus, the toner image on the transfer belt 30 is transferred.

The timing of conveyance of the paper sheet to the secondary transfer roller 33 is controlled by the registration rollers 40 in accordance with the position of the toner image on the transfer belt 30. As a result, the toner image on the transfer belt 30 is transferred to an appropriate position on the paper sheet.

The fixing unit 60 pressurizes and heats the paper sheet passing through the fixing unit 60. As a result, the toner image formed on the paper sheet is fixed onto the paper sheet. The paper sheet is then ejected onto a catch tray 48. The fixing unit 60 and the control process for the fixing unit 60 will be described later in detail.

The cleaning unit 43 collects the toner remaining on the surface of the transfer belt 30 after the transfer of the toner image from the transfer belt 30 onto the paper sheet. The collected toner is conveyed by a conveyance screw (not shown), and is stored into a toner waste container (not shown).

[2. Hardware Configuration]

Figure 2:
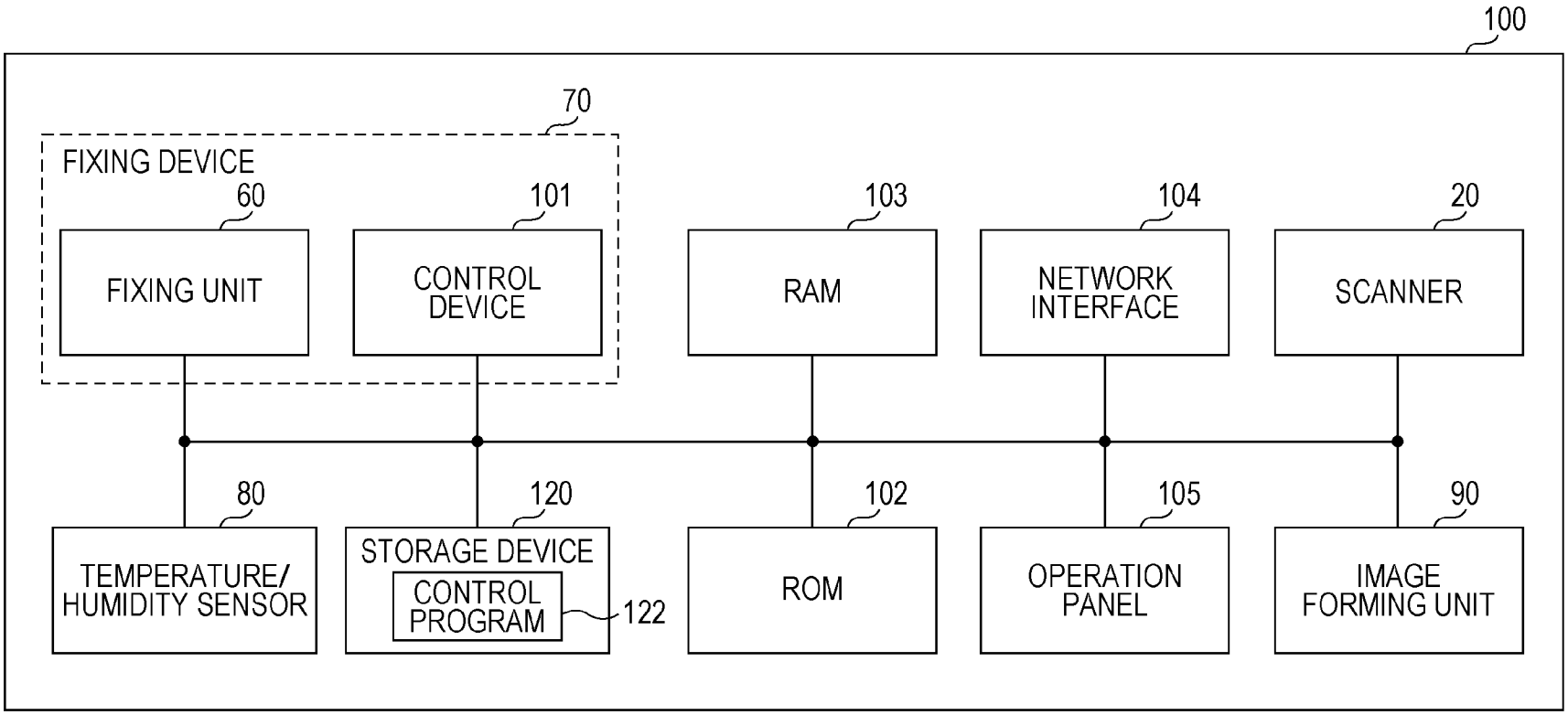
FIG. 2 is a block diagram showing the hardware configuration of the image forming apparatus.

Referring now to FIG. 2, an example of the hardware configuration of the image forming apparatus 100 is described. FIG. 2 is a block diagram showing the hardware configuration of the image forming apparatus 100.

As shown in FIG. 2, the image forming apparatus 100 includes the control device 101, a read only memory (ROM) 102, a random access memory (RAM) 103, a network interface 104, an operation panel 105, the scanner 20, an image forming unit 90, a storage device 120, a temperature/humidity sensor 80, and the fixing unit 60. As shown in FIG. 2, the control device 101 and the fixing unit 60 constitute a fixing device 70.

The control device 101 is formed with at least one integrated circuit, for example. An integrated circuit is formed with at least one central processing unit (CPU), at least one application specific integrated circuit (ASIC), at least one field programmable gate array (FPGA), or a combination of these circuits.

The control device 101 controls operation of the image forming apparatus 100 by executing various programs such as a program 122 for adjusting the control parameters for the image forming apparatus 100. Upon receipt of an instruction to execute the program 122, the control device 101 reads the program 122 from the storage device 120 into the RAM 103. The RAM 103 functions as a working memory, and temporarily stores various kinds of data necessary for executing the program 122.

An antenna (not shown) or the like is connected to the network interface 104. The image forming apparatus 100 exchanges data with external communication devices via the antenna. Examples of such external communication devices include mobile communication terminals such as smartphones, and servers. The image forming apparatus 100 may be designed to be capable of downloading the program 122 from a server via the antenna.

The operation panel 105 includes a display (not shown) and a touch panel (not shown). The display and the touch panel are stacked on each other, and the image forming apparatus 100 accepts an operation through the touch panel.

The temperature/humidity sensor 80 includes a thermometer and a hygrometer for detecting the temperature and the humidity inside the image forming apparatus 100 (the temperature will be hereinafter also referred to as the environmental temperature). In accordance with the information acquired by the temperature/humidity sensor 80, the control device 101 controls the various parameters in image formation.

The storage device 120 is a hard disk, a solid state drive (SSD), or some other storage device, for example. The storage device 120 may be either of an internal type or of an external type. The storage device 120 stores the program 122 and the like according to this embodiment. However, the location of storage of the program 122 is not necessarily the storage device 120. The program 122 may be stored in a storage area (such as a cache) in the control device 101, the ROM 102, the RAM 103, an external device (such as a server), or the like.

The program 122 may not be provided as a single program, but may be incorporated into any appropriate program. In this case, the control process according to this embodiment is performed in cooperation with any appropriate program. Even such a program that does not include some modules does not depart from the scope of the program 122 according to this embodiment.

Further, some function(s) or all of the functions to be provided by the program 122 may be provided by special-purpose hardware. Alternatively, the control process according to this embodiment may be in the form a cloud service, and at least one server performs part of the process according to the program 122.

[3. Fixing Device 70]

(3.1. Configuration)

Figure 3A:
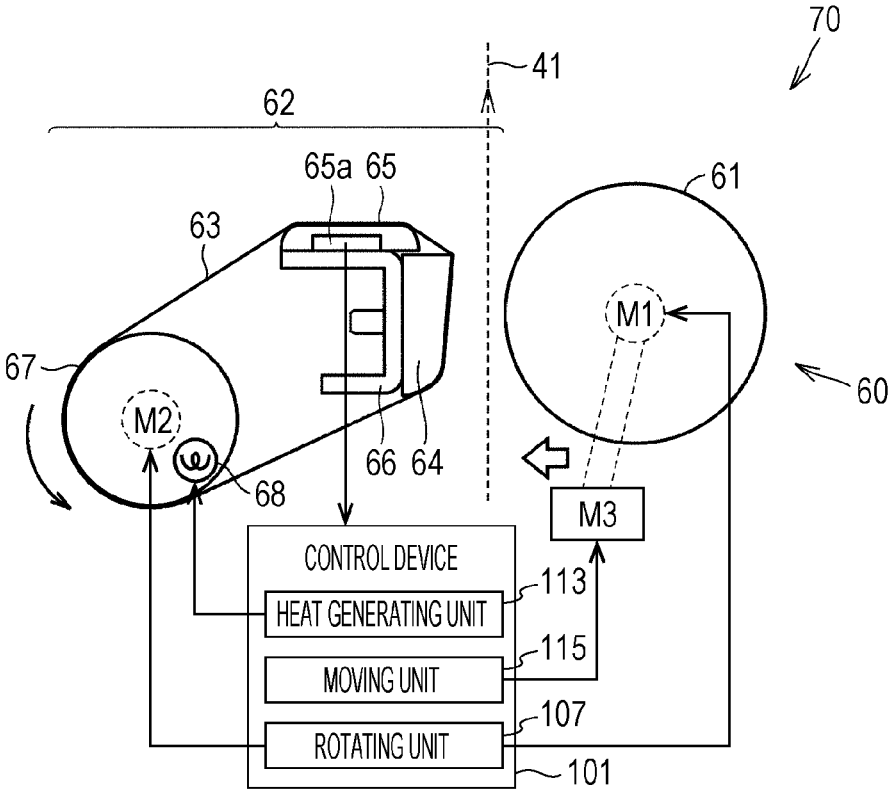
FIGS. 3A and 3B are diagrams schematically showing a fixing device according to a first embodiment.
Figure 3B:
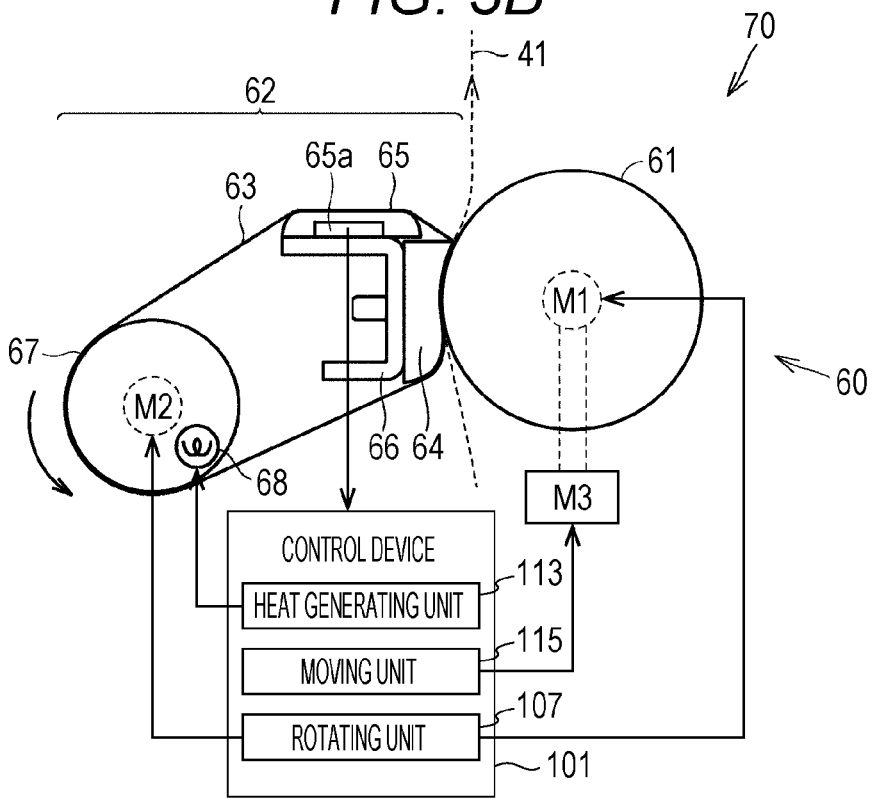

Referring now to FIGS. 3A and 3B, the fixing device 70 according to the first embodiment is described. FIGS. 3A and 3B are diagrams schematically showing the fixing device 70 according to the first embodiment.

As shown in FIG. 3A, the fixing device 70 includes the control device 101 and the fixing unit 60. The fixing unit 60 includes a pressure roller 61, a heating member 62, and drive motors M1, M2, and M3. The control device 101 and the drive motors M1, M2, and M3 constitute a drive mechanism.

The pressure roller 61 can be rotated by the drive motor M1. A rotating unit 107 of the control device 101 controls the drive motor M1 so that the pressure roller 61 rotates. The heating member 62 includes a fixing belt 63, a pressure pad 64, a lubricant supply unit 65, a supporting unit 66, and a heating roller 67.

The fixing belt 63 is wound around the heating roller 67 and the pressure pad 64 in an endless manner by a predetermined tension T. The structure of the fixing belt 63 may be a single-layer structure or a multilayer structure. Examples of a belt having a multilayer structure include those having a base layer and a release layer.

Examples of the material of the base layer of the fixing belt 63 include thermosetting polyimide, thermoplastic polyimide, polyamide, and polyamideimide. Examples of the material of the release layer of the fixing belt 63 include PFA (tetrafluoroethylene-perfluoroalkyl vinyl ether copolymer), PTFE (polytetrafluoroethylene), and composite materials of these materials.

The pressure pad 64 is disposed to face the pressure roller 61, and is formed with an elastic body such as a resin. For example, the pressure pad 64 is formed with an elastic body such as silicone rubber or fluorine-containing rubber, a heat-resistant resin such as PPS, polyimide, polyester, or polyamide, a metal such as iron, aluminum, or SUS, or a leaf spring.

The supporting unit 66 supports the pressure pad 64 and the lubricant supply unit 65. In the lubricant supply unit 65, felt is impregnated with a lubricant, and the lubricant is supplied between the pressure pad 64 and the fixing belt 63.

The lubricant may be a fatty acid metal salt, for example. The fatty acid of the fatty acid metal salt is preferably myristic acid, palmitic acid, stearic acid, oleic acid, or the like. Examples of the metal of the fatty acid metal salt include lithium, magnesium, calcium, strontium, zinc, cadmium, aluminum, cerium, titanium, and iron.

The lubricant supply unit 65 further includes a temperature sensor 65*a* for measuring the temperature of the lubricant. The lubricant temperature information acquired by the temperature sensor 65*a* is output to the control device 101.

A heater 68 is provided inside the heating roller 67. The heater 68 is made to generate heat by a heat generating unit 113 of the control device 101. As the heater 68 generates heat, the heating roller 67 is heated.

The heating roller 67 can be rotated by the drive motor M2. The rotating unit 107 of the control device 101 controls the drive motor M2 so that the heating roller 67 rotates.

As the heating roller 67 rotates, the fixing belt 63 is driven in an endless manner by the frictional force generated between the fixing belt 63 and the heating roller 67 by the tension T. As a result, the heat generated by the heater 68 is transmitted to the pressure pad 64 by the fixing belt 63, which is driven while sliding on the surface of the pressure pad 64. As a result, the paper sheet being conveyed in the conveyance path 41 formed between the pressure roller 61 and the heating member 62 is heated. At this stage, the movement of the fixing belt 63 has been detected by a movement sensor (not shown).

The pressure roller 61 can be designed to be movable in relation to the heating member 62. Specifically, a moving unit 115 of the control device 101 controls the drive motor M3 so that it is possible to switch between a contact state (see FIG. 3B) in which the pressure roller 61 and the fixing belt 63 are in contact with each other, and a separated state (see FIG. 3A) in which the pressure roller 61 and the fixing belt 63 are separated from each other. The pressure roller 61 is moved by the moving unit 115, to pressurize the pressure pad 64. As a result, the paper sheet being conveyed in the conveyance path 41 is pressurized. As described above, the fixing device 70 fixes the toner image formed on a paper sheet to the paper sheet by heating and pressurizing the paper sheet being conveyed in the conveyance path 41.

(3.2. Overview of Warm-Up Control)

Next, warm-up control to be performed in the fixing device 70 is described. The warm-up control to be described herein is control for increasing the temperature of the pressure pad 64 to a predetermined temperature before a fixing operation is performed on a paper sheet having a toner image formed thereon.

In this embodiment, at the start of the warm-up control, the moving unit 115 is in a contact state in which the pressure roller 61 and the fixing belt 63 are in contact with each other. As the pressure roller 61 and the fixing belt 63 are brought into contact with each other at the start of warm-up as described above, the fixing belt 63 can be driven in a reliable manner by rotation of the pressure roller 61. More specifically, a frictional force is generated between the fixing belt 63 and the pressure roller 61 due to the pressure from the pressure roller 61. As the pressure roller 61 then rotates, the frictional force causes the fixing belt 63 to move.

After the fixing belt 63 is driven, the heat generating unit 113 causes the heater 68 to generate heat. The heat generated in the heater 68 is transmitted to the lubricant supply unit 65 as the fixing belt 63 moves. The heated lubricant is then supplied from the lubricant supply unit 65 to the surface of the pressure pad 64, and the friction coefficient between the pressure pad 64 and the fixing belt 63 becomes lower. As a result, the fixing belt 63 becomes capable of moving even when only the heating roller 67 is rotating.

The moving unit 115 preferably controls movement of the pressure roller 61 so that the pressure generated during the warm-up control between the pressure roller 61 and the fixing belt 63 becomes lower than the pressure generated during the period in which the sheet fixing operation is performed after the warm-up control is completed. In this manner, it is possible to reduce the power to be consumed by the drive motor M1 for rotating the pressure roller 61. In the description below, the pressure generated between the pressure roller 61 and the fixing belt 63 during the period in which the sheet fixing operation is performed will be referred to as the normal pressure, and the pressure that is generated during the warm-up period and is lower than the normal pressure will be also referred to as the light pressure.

Further, during the period in which the contact state for the warm-up control is maintained, the rotating unit 107 preferably rotates the pressure roller 61 at a lower speed than in the period after the warm-up is completed. Since the output of the drive motor M1 is determined by the product of the rotation speed and the rotation torque, it is possible to rotate the pressure roller 61 with a higher rotation torque by lowering the rotation speed. Thus, the fixing belt 63 can be driven in a more reliable manner.

Further, during the period in which the contact state for the warm-up control is maintained, the moving unit 115 preferably moves the pressure roller 61 so that the frictional force generated between the pressure roller 61 and the fixing belt 63 becomes greater than the frictional force generated between the heating roller 67 and the fixing belt 63 by the tension of the fixing belt 63 in a separated state. With this arrangement, even in a case where the fixing belt 63 cannot be driven by rotation of the heating roller 67 in a separated state, it is possible to rotate the pressure roller 61 in a contact state, and cause the fixing belt 63 to move.

For example, the moving unit 115 moves the pressure roller 61, to presses the pressure roller 61 against the fixing belt 63 with about 150 N. Since the tension of the fixing belt 63 in a separated state is about 40N, a frictional force greater than the frictional force to be generated between the heating roller 67 and the fixing belt 63 can be generated between the pressure roller 61 and the fixing belt 63. Thus, even in a case where the fixing belt 63 cannot be driven by rotation of the heating roller 67 in a separated state, it is possible to drive the fixing belt 63 in a reliable manner by rotation of the pressure roller 61 in a contact state.

[4. Processing Procedures]

Figure 4:
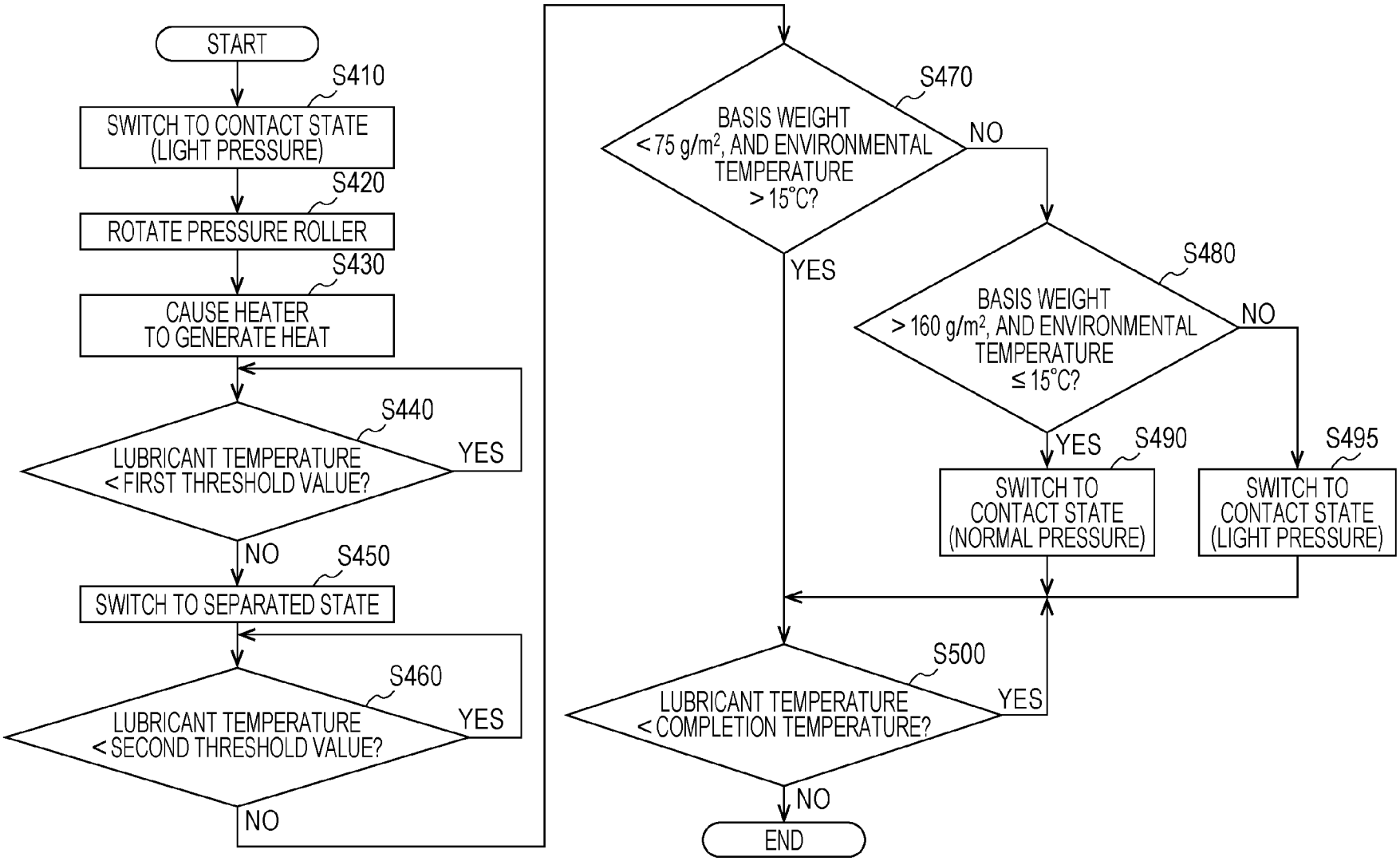
FIG. 4 is a diagram showing the procedures in a warm-up control process.

Referring now to FIG. 4, the procedures in a warm-up control process according to the first embodiment are described. FIG. 4 is a flowchart showing the procedures in the warm-up control process. This process is performed by the CPU functioning as the control device 101 and executing a predetermined program, for example.

In step S410, the control device 101 as the moving unit 115 moves the pressure roller 61, to switch to a contact state with the light pressure. The control device 101 then advances the process to step S420.

In step S420, the control device 101 as the rotating unit 107 starts to rotate the pressure roller 61. The control device 101 then advances the process to step S430.

In step S430, the control device 101 as the heat generating unit 113 causes the heater 68 to generate heat. The control device 101 then advances the process to step S440.

In step S440, the control device 101 determines whether the temperature of the lubricant is lower than a first threshold value. If the temperature of the lubricant is lower than the first threshold value (YES in step S440), the control device 101 continues the process. If the temperature of the lubricant is not lower than the first threshold value (NO in step S440), the control device 101 advances the process to step S450.

In step S450, the control device 101 as the moving unit 115 moves the pressure roller 61, to switch to a separated state. The control device 101 then advances the process to step S460.

In step S460, the control device 101 determines whether the temperature of the lubricant is lower than a second threshold value. If the temperature of the lubricant is lower than the second threshold value (YES in step S460), the control device 101 continues the process. If the temperature of the lubricant is not lower than the second threshold value (NO in step S460), the control device 101 advances the process to step S470.

In step S470, the control device 101 determines whether the basis weight set in the sheet feed tray and the environmental temperature satisfy predetermined first conditions. For example, if the basis weight is smaller than 75 g/m$^2$, and the environmental temperature is higher than 15° C. (YES in step S470), the control device 101 advances the process to step S500. If the basis weight is not smaller than 75 g/m$^2$, or the environmental temperature is not higher than 15° C. (NO in step S470), the control device 101 advances the process to step S480.

In step S480, the control device 101 determines whether the basis weight set in the sheet feed tray and the environmental temperature satisfy predetermined second conditions. For example, if the basis weight is greater than 160 g/m$^2$ and the environmental temperature is equal to or lower than 15° C. (YES in step S480), the control device 101 advances the process to step S490. If the basis weight is not greater than 160 g/m$^2$, or the environmental temperature is higher than 15° C. (NO in step S480), the control device 101 advances the process to step S495.

In step S490, the control device 101 as the moving unit 115 moves the pressure roller 61, to switch to a contact state with the normal pressure. The control device 101 then advances the process to step S500.

In step S495, the control device 101 as the moving unit 115 moves the pressure roller 61, to switch to a contact state with the light pressure. The control device 101 then advances the process to step S500.

In step S500, the control device 101 determines whether the temperature of the lubricant is lower than the warm-up completion temperature. If the temperature of the lubricant is lower than the warm-up completion temperature (YES in step S500), the control device 101 continues the process. If the temperature of the lubricant is not lower than the warm-up completion temperature (NO in step S500), the control device 101 ends the process.

[5. Timings to Switch Between a Contact State and a Separated State]

Figure 5:
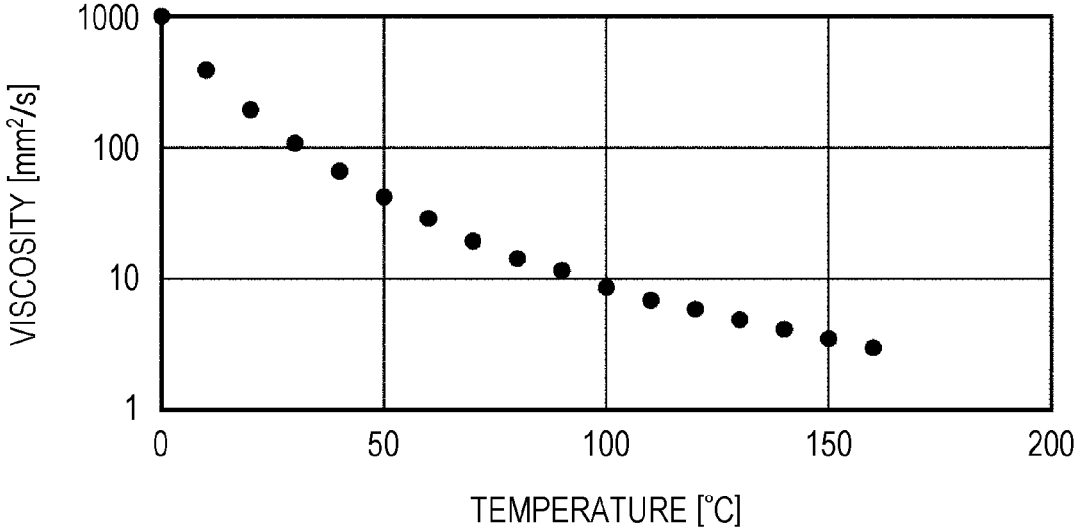
FIG. 5 is a graph showing the relationship between the viscosity of a lubricant and temperature.
Figure 6:
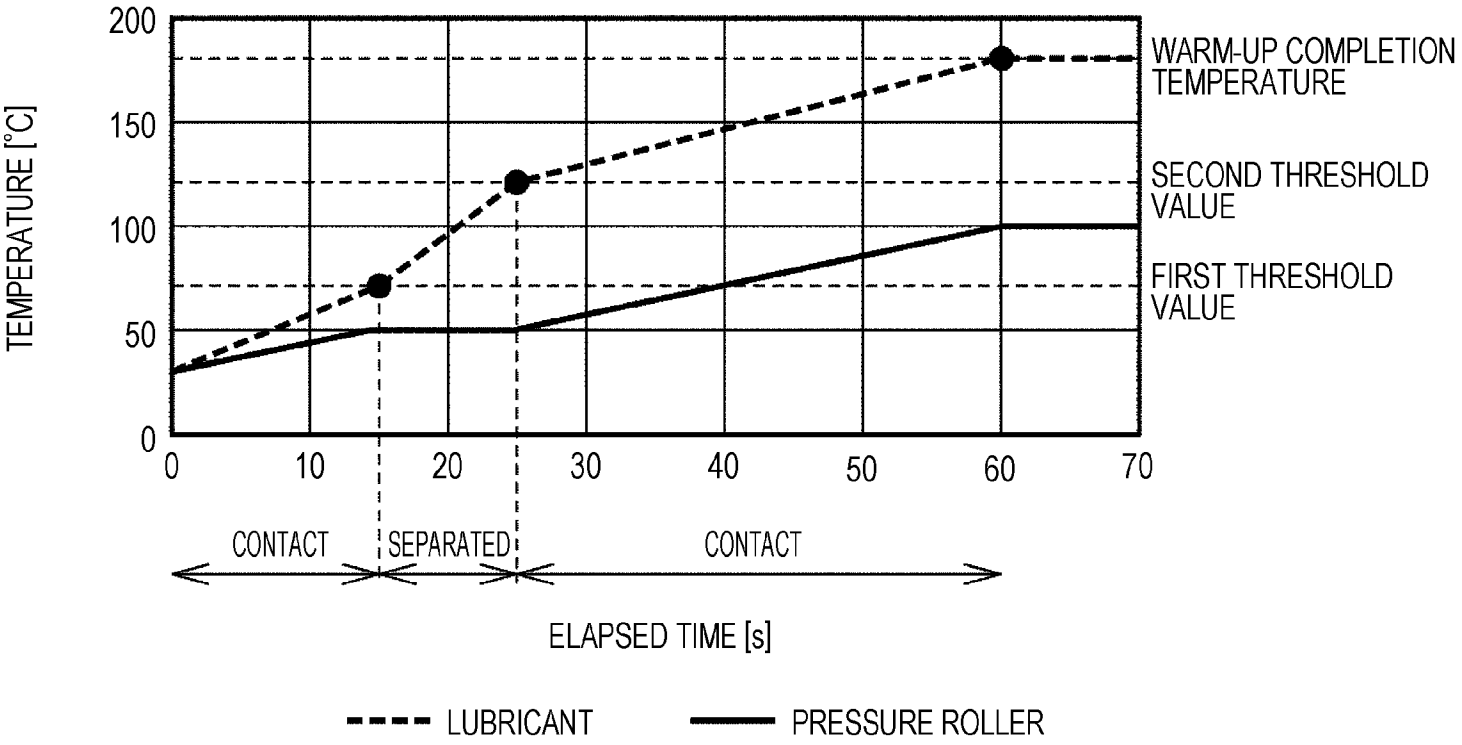
FIG. 6 is a graph showing the relationship between the time elapsed since the start of warm-up control and the temperatures of the lubricant and a pressure roller.

Referring now to FIGS. 5 and 6, the timings to switch between a contact state and a separated state are described. FIG. 5 is a graph showing the relationship between the viscosity of the lubricant and temperature. FIG. 6 is a graph showing the relationship between the time elapsed since the start of warm-up control and the temperatures of the lubricant and the pressure roller.

As shown in FIG. 5, as temperature drops, the viscosity of the lubricant increases. Therefore, in a low-temperature environment, the viscosity of the lubricant becomes higher, and the fixing belt 63 becomes more likely to adhere to the pressure pad 64. Further, in a low-temperature region, the viscosity varies greatly with a temperature change.

The lubricant supplied to the surface of the pressure pad 64 is selected so as to have the optimum viscosity at the environmental temperature (higher than room temperature) during the printing process. Therefore, the viscosity becomes higher at a time of warm-up control in a room-temperature environment, and as a result, the friction coefficient generated between the fixing belt 63 and the pressure pad 64 also becomes higher. Particularly, in a case where the temperature is lower than the lower limit of the operation-guaranteed temperature of the image forming apparatus 100, which is 10° C., or in a case where the viscosity has become higher due to reduced durability of the surface of the pressure pad 64 even though the temperature is within the operation-guaranteed temperature range, it might be difficult to drive the fixing belt 63 by rotating the heating roller 67.

On the other hand, as shown in FIG. 5, when the temperature rises, the viscosity of the lubricant becomes lower, and the friction coefficient generated between the fixing belt 63 and the pressure pad 64 also becomes lower. When the friction coefficient becomes lower, it becomes easier to drive the fixing belt 63 by rotating the heating roller 67.

Therefore, as shown in FIG. 6, after the warm-up control starts, the rotating unit 107 drives the fixing belt 63 by rotating the pressure roller 61 remaining in a contact state in which the pressure roller 61 is in contact with the fixing belt 63, until the temperature of the lubricant detected by the temperature sensor 65*a* reaches the first threshold value at which the lubricant has an appropriate viscosity. When the temperature of the lubricant exceeds the first threshold value, the moving unit 115 moves the pressure roller 61, to switch the contact state to a separated state (equivalent to step S450).

In this manner, the viscosity of the lubricant becomes lower, the friction coefficient between the fixing belt 63 and the pressure pad 64 becomes lower, and it becomes possible to drive the fixing belt 63 only by rotating the heating roller 67. After that, the contact state is switched to a separated state. Thus, heat from the heater 68 is not released to the pressure roller 61, and the heating member 62 can be efficiently warmed up.

More preferably, when the temperature of the lubricant exceeds the second threshold value, which is higher than the first threshold value, as shown in FIG. 6, the moving unit 115 switches to a contact state (equivalent to steps S490 and S495). With this arrangement, in a case where it is necessary for the pressure roller 61 to store heat, such as when the basis weight of the print target is large, when the environmental temperature is low, or the number of paper sheets on which printing is to be performed is large, the heating member 62 and the pressure roller 61 are again brought into contact with each other, so that the pressure roller 61 can store heat.

Here, the second threshold value is determined from the time required for storing the necessary amount of heat into the pressure roller 61 before completion of the warm-up, and the rate of temperature rise. The moving unit 115 may switch the pressure between the pressure roller 61 and the fixing belt 63 in a contact state between the light pressure and the normal pressure, in accordance with the necessary storage of heat. Further, in a case where heat storage is not necessary, such as when the environmental temperature is high, when the paper sheets are thin, or when the number of paper sheets to be passed is small, the moving unit 115 may remain in a separated state even after the temperature of the lubricant reaches the second threshold value.

In this manner, the storage of heat in the pressure roller 61 immediately after completion of the warm-up can be adjusted to the amount of heat necessary for the subsequent printing process. Thus, the printing process can be immediately started. In this example, a separated state is maintained until the temperature of the lubricant changes from the first threshold value to the second threshold value. Accordingly, the pressure roller 61 is not heated, and all the heat generated from the heater 68 is used to heat the heating member 62. Thus, during this period, the temperatures of the heating member 62 and the lubricant are raised at the highest rate.

[6. Brief Summary]

As described above, in this embodiment, the control device 101 is designed to be capable of switching between a contact state in which the pressure roller 61 and the fixing belt 63 are in contact with each other, and a separated state in which the pressure roller 61 and the fixing belt 63 are separated from each other. At a start of warm-up of the heating member 62, the control device 101 switches to a contact state, and causes the pressure roller 61 to rotate.

With the above structure, even in a case where the fixing belt 63 adheres to the pressure pad 64 due to an undesirable usage environment or condition or the like, and cannot be driven only by rotation of the heating roller 67, the pressure roller 61 can be brought into contact with the fixing belt 63 while being rotated. Thus, the fixing belt 63 can be driven in a reliable manner.

[7. Modification]

Figure 7:
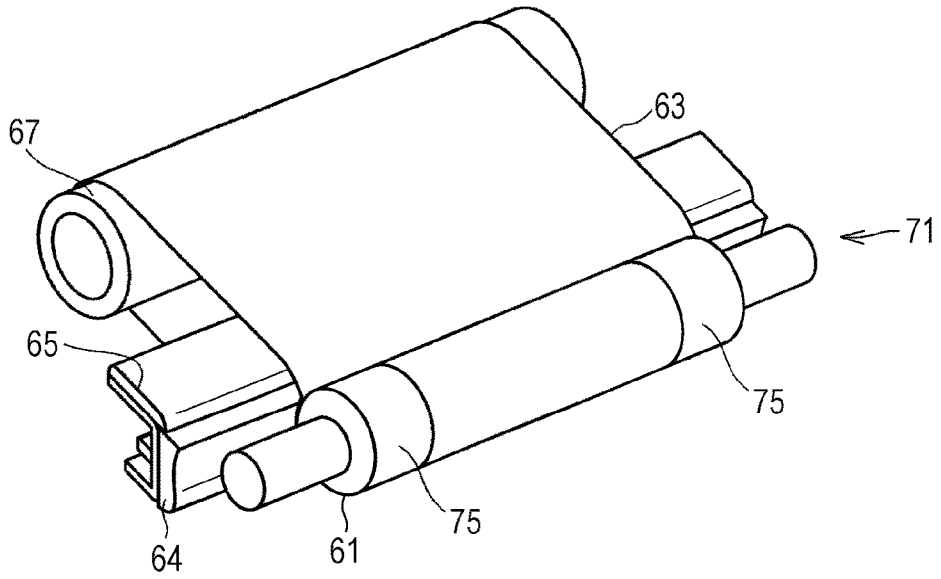
FIG. 7 is a diagram showing a fixing unit according to a modification.

Referring now to FIG. 7, a fixing unit 71 according to a modification is described. FIG. 7 is a diagram showing the fixing unit 71 according to the modification.

As shown in FIG. 7, the fixing unit 71 according to the modification includes not only the components of the fixing unit 60 but also grips 75 at both ends of the pressure roller 61 in the rotational axis direction. The grips 75 has a higher friction coefficient than that of the central portion in the rotational axis direction.

The grips 75 are the end portions of the pressure roller 61 in its longitudinal direction, and are provided in regions with which the paper sheets passing through the portion between the pressure roller 61 and the heating member 62 are not to be brought into contact. Preferably, as shown in FIG. 7, the grips 75 are provided at both ends of the pressure roller 61 in its longitudinal direction. With this, when the control device 101 switches to a contact state at the start of warm-up control, the frictional force generated between the pressure roller 61 and the fixing belt 63 becomes greater, so that the fixing belt 63 can be driven in a more reliable manner.

Second Embodiment

[1. Overview]

Next, a second embodiment is described. The second embodiment differs from the first embodiment in that a control device determines whether to switch to a separated state or whether to switch to a contact state at the start of warm-up. In this embodiment, the same components as those of the image forming apparatus 100 according to the above embodiment are denoted by the same reference numerals as those used for the image forming apparatus 100. Therefore, explanation of them is not repeated herein.

[2. Details]

Figure 8:
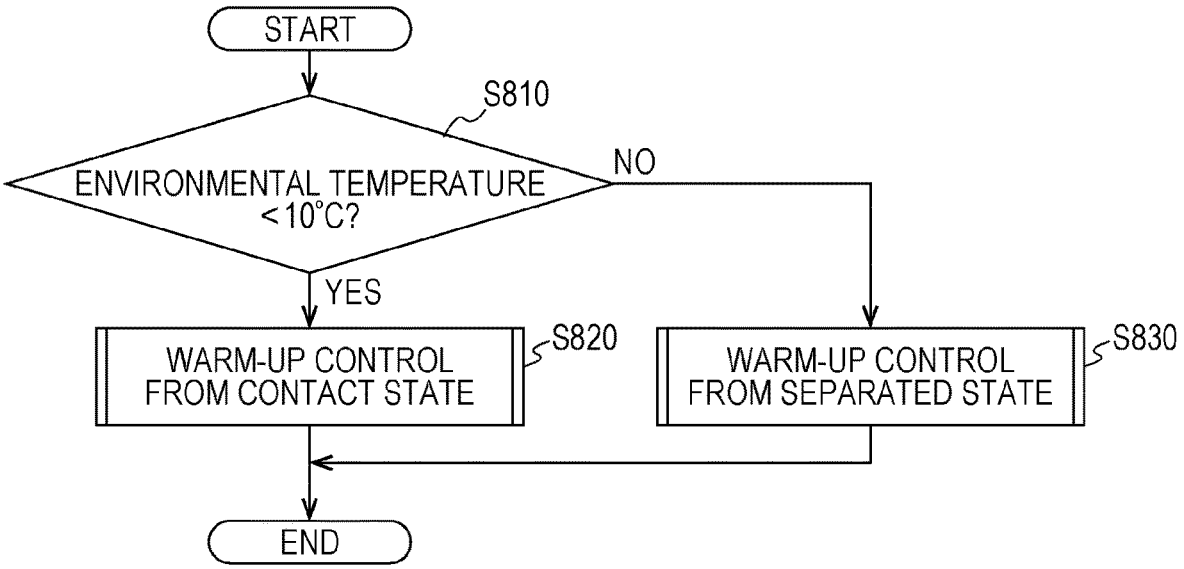
FIG. 8 is a diagram showing the procedures in a warm-up control process according to a second embodiment.

Referring now to FIG. 8, the procedures in a warm-up control process according to the second embodiment are described. FIG. 8 is a diagram showing the procedures in the warm-up control process according to the second embodiment.

In step S810, the control device 101 determines whether the environmental temperature is 10° C. or lower. If the environmental temperature is 10° C. or lower (YES in step S810), the control device 101 advances the process to step S820. If the environmental temperature is higher than 10° C. (NO in step S810), the control device 101 advances the process to step S830.

In step S820, the control device 101 performs warm-up control from a contact state. Here, the warm-up control from a contact state means the warm-up control according to the first embodiment (equivalent to steps S410 through S500 in FIG. 4). The control device 101 then ends the process.

In step S830, on the other hand, the control device 101 performs warm-up control from a separated state. The warm-up control from a separated state will be described later in detail. The control device 101 then ends the process.

Figure 9:
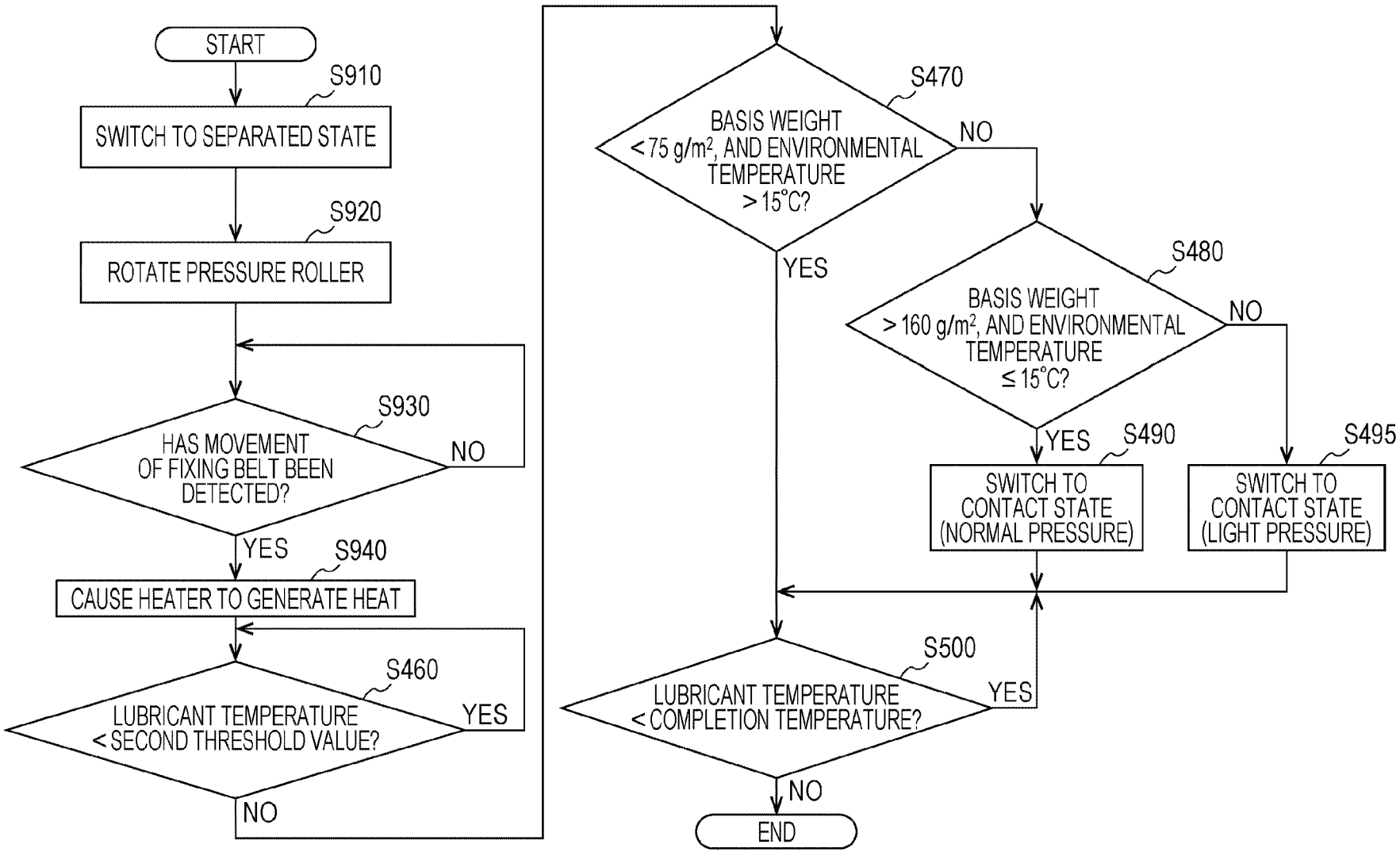
FIG. 9 is a diagram showing the processing procedures in a warm-up control process from a separated state.

Referring now to FIG. 9, the processing procedures in the warm-up control from a separated state are described. FIG. 9 is a diagram showing the processing procedures in the warm-up control from a separated state. This process is performed by the CPU functioning as the control device 101 and executing a predetermined program, for example. The same steps as those of the first embodiment are given the same step numbers, and explanation of them is not repeated herein.

In step S910, the control device 101 as the moving unit 115 moves the pressure roller 61, to switch to a separated state. The control device 101 then advances the process to step S920.

In step S920, the control device 101 as the rotating unit 107 starts to rotate the pressure roller 61. The control device 101 then advances the process to step S930.

In step S930, the control device 101 determines whether movement of the fixing belt 63 has been detected by the movement sensor. If movement of the fixing belt 63 has not been detected (NO in step S930), the control device 101 continues the process. If movement of the fixing belt 63 has been detected (YES in step S930), the control device 101 advances the process to step S940.

In step S940, the control device 101 as the heat generating unit 113 causes the heater 68 to generate heat. The control device 101 then advances the process to step S460. After that, the control device 101 performs the process from step S460 through step S500.

Figure 10:
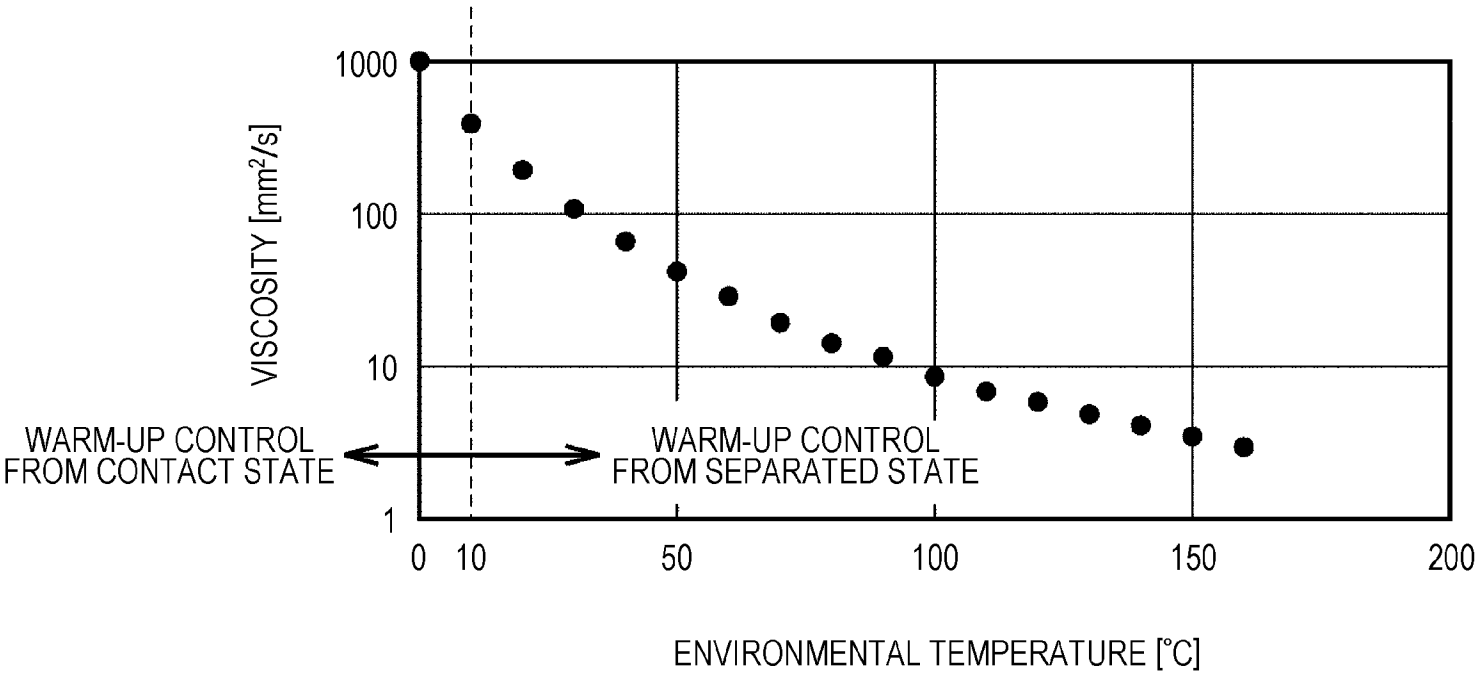
FIG. 10 is a graph showing the relationship between the viscosity of the lubricant and warm-up control.

Referring now to FIG. 10, the relationship between the viscosity of the lubricant and switching of warm-up control according to the second embodiment is described. FIG. 10 is a graph showing the relationship between the viscosity of the lubricant and switching of warm-up control.

In this embodiment, as described above, a warm-up control process from a contact state is performed in a case where the environmental temperature is lower than 10° C., and a warm-up control process from a separated state is performed in a case where the environmental temperature is 10° C. or higher. Since the operation-guaranteed environmental temperature range for the image forming apparatus 100 of this embodiment is set at 10° C. or higher, the above process is performed so that the fixing belt 63 can be driven in a reliable manner in a low-temperature environment at 10° C. or lower.

As shown in FIG. 10, the environmental temperature and the temperature of the lubricant are closely related. Therefore, in this embodiment, the control device 101 determines whether to perform warm-up control from a contact state or whether to perform warm-up control from a separated state, depending on the environmental temperature.

It should be noted that the control device 101 may perform warm-up control from a contact state in a case where the temperature of the lubricant is lower than a predetermined temperature, and perform warm-up control from a separated state in a case where the temperature of the lubricant is equal to or higher than the predetermined threshold value. Alternatively, the control device 101 may perform warm-up control from a contact state in a case where the temperature of the fixing belt 63 is lower than a predetermined threshold value, and perform warm-up control from a separated state in a case where the temperature of the fixing belt 63 is equal to or higher than the predetermined threshold value. In such cases, the respective predetermined threshold values are set in accordance with the fixing belt 63 and the lubricant.

In other words, in a case where at least one of the environmental temperature outside the fixing device 70, the temperature of the fixing belt 63, and the temperature of the lubricant is lower than a predetermined threshold value at the start of warm-up, the control device 101 may switch to a contact state. Further, in a case where at least one of the environmental temperature outside the fixing device 70, the temperature of the fixing belt 63, and the temperature of the lubricant is not lower than the predetermined threshold value at the start of warm-up, the control device 101 may switch to a separated state.

Alternatively, the control device 101 may determine whether to perform warm-up control from a separated state or whether to perform warm-up control from a contact state, depending on the amount of work to be carried out by the fixing device 70, such as the number of paper sheets on which printing is to be performed. For example, the control device 101 performs warm-up control from a contact state in a case where the amount of work exceeds a predetermined work amount, or performs warm-up control from a separated state in a case where the amount of operation is equal to or smaller than the predetermined work amount.

Further, in this embodiment, after movement of the fixing belt 63 being moved by rotation of the heating roller 67 is detected in a separated state, the heat generating unit 113 causes the heater 68 to generate heat. In this manner, the temperature of the lubricant around the heating roller 67 rises due to the heat generated from the heater 68, and the viscosity becomes lower accordingly. Thus, the heating roller 67 can be prevented from idling.

[3. Brief Summary]

As described above, in this embodiment, the control device 101 switches between a separated state and a contact state at the start of warm-up, depending on the environmental temperature.

With the above configuration, it is possible to determine whether the fixing belt 63 can be driven only by the frictional force generated by rotation of the heating roller 67 in accordance with the environmental temperature, and it is possible to switch between a contact state and a separated state at the start of warm-up. As a result, while the fixing belt 63 is driven in a reliable manner, a contact state is maintained only if necessary, and the contact state is replaced with a separated state as appropriate. Thus, warm-up can be completed in a short period of time.

Third Embodiment

[1. Overview]

Next, a third embodiment is described. The third embodiment differs from the first embodiment in that the drive mechanism performs warm-up control in a contact state in a case where movement of the fixing belt cannot be detected after warm-up control is performed in a separated state. It should be noted that an image forming apparatus according to this embodiment is formed with the same configuration as the hardware configuration of the image forming apparatus 100 according to the above embodiment. Therefore, explanation of them is not repeated herein.

[2. Details]

Figure 11:
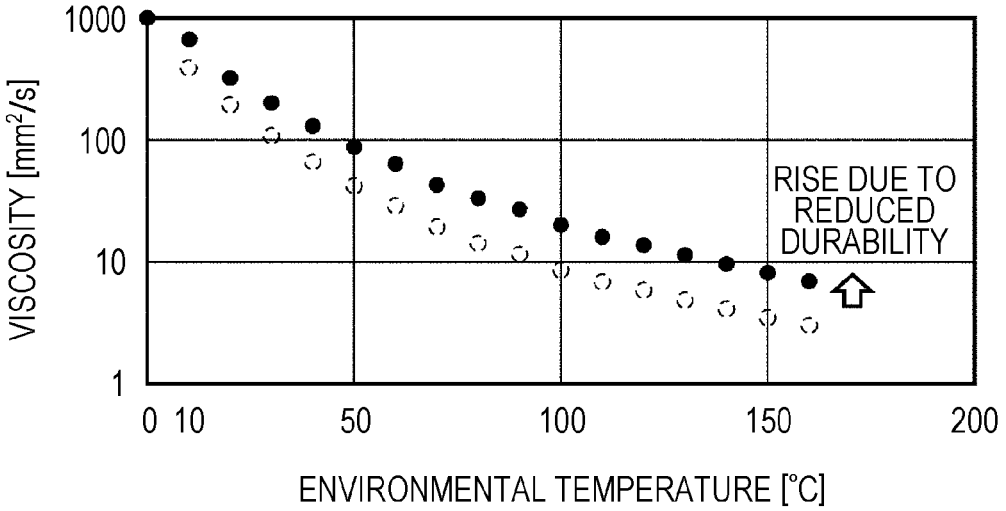
FIG. 11 is a graph showing the relationship between the viscosity of the lubricant and the amount of work carried out by a heating member.

Referring now to FIG. 11, the relationship between the viscosity of the lubricant and the amount work carried out by the heating member 62 is described. FIG. 11 is a graph showing the relationship between the viscosity of the lubricant and the amount of work carried out by the heating member 62.

As the amount work carried out by the heating member 62 increases, the relationship between the viscosity of the lubricant and the temperature changes due to deformation in conformity with the shape of the pressure pad 64 of the fixing belt 63, deterioration of the lubricant due to its reduced durability, depletion of the lubricant, or the like. Specifically, as shown in FIG. 11, the viscosity becomes higher with changes in temperature. In this case, it becomes difficult to accurately determine whether to set a contact state at the start of warm-up in accordance with the environmental temperature.

Therefore, in the third embodiment, a separated state is set at the start of warm-up. If any movement of the fixing belt 63 is not detected in a predetermined time, a contact state is set, and the pressure roller 61 is rotated, to drive the fixing belt 63.

Figure 12:
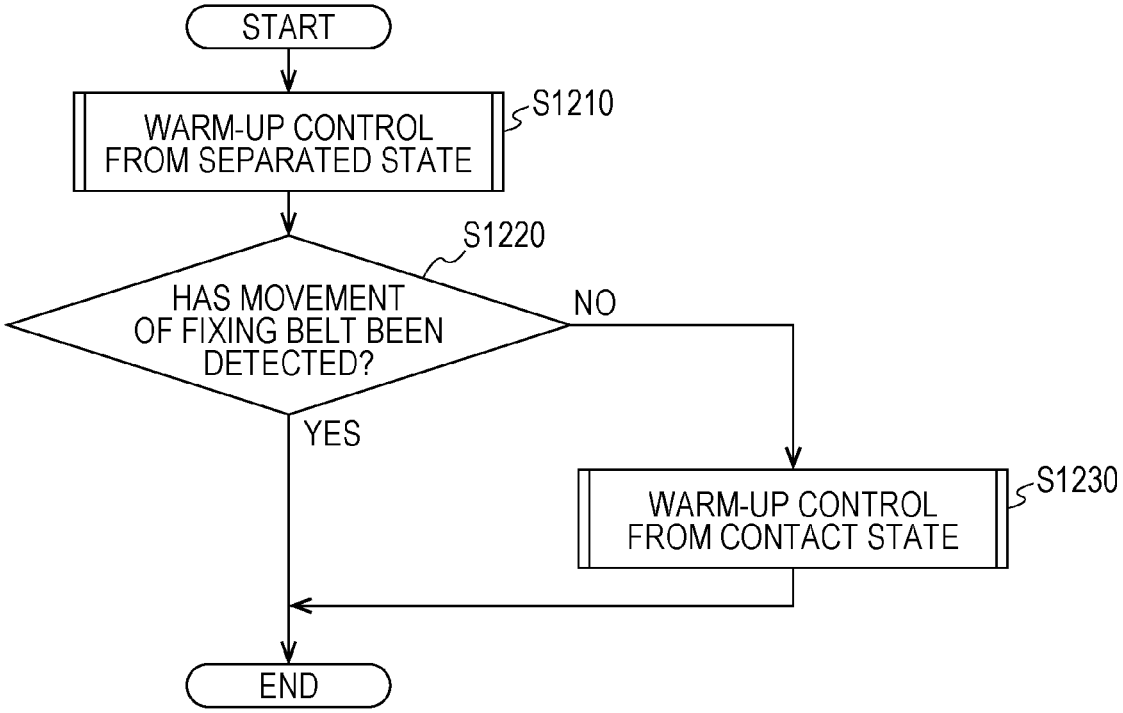
FIG. 12 is a diagram showing the procedures in a warm-up control process according to a third embodiment.

Referring now to FIG. 12, the processing procedures in a warm-up control process according to the third embodiment are described. FIG. 12 shows the processing procedures in a warm-up control process according to the third embodiment. This process is performed by the CPU functioning as the control device 101 and executing a predetermined program, for example.

In step S1210, the control device 101 performs warm-up control from a separated state (equivalent to steps S910 through S500 in FIG. 9). The control device 101 then advances the process to step S1220.

In step S1220, the control device 101 determines whether movement of the fixing belt 63 has been detected by the movement sensor. If movement of the fixing belt 63 has been detected (YES in step S1220), the control device 101 ends the process. If any movement of the fixing belt 63 has not been detected (NO in step S1220), the control device 101 advances the processing to step S1230.

In step S1230, the control device 101 performs warm-up control from a contact state (equivalent to steps S410 through S500 in FIG. 4). The control device 101 then ends the process.

[3. Brief Summary]

As described above, in the third embodiment, after warm-up control from a separated state is performed, warm-up control from a contact state is further performed in a case where any movement of the fixing belt 63 has not been detected.

With the above configuration, warm-up can be performed in a short time in a case where movement of the fixing belt 63 has been detected after only warm-up control from a separated state. In a case where any movement of the fixing belt 63 has not been detected, on the other hand, warm-up control from a contact state is further performed. Thus, the fixing belt 63 can be driven in a reliable manner.

Other Embodiments

It should be understood that the scope of application of the technical idea according to the present disclosure is not limited to the above embodiments. For example, instead of moving the pressure roller 61, the moving unit 115 of the control device 101 may move the heating member 62, or may move both the pressure roller 61 and the heating member 62. That is, the moving unit 115 moves the pressure roller 61 and/or the heating member 62. Further, the conditions for switching between a separated state and a contact state may include a threshold value that is the amount of work carried out by the fixing device 70 based on the number of paper sheets on which printing has been performed, instead of or in addition to the environmental temperature and the basis weight.

Furthermore, switching between a contact state and a separated state during the period of warm-up control may be determined in accordance with a detected temperature such as the temperature of the fixing belt 63 or the environmental temperature, instead of the temperature of the lubricant. In this case, a first threshold value and a second threshold value corresponding to respective detected temperatures are set.

For example, during the period of a contact state in warm-up control, the moving unit 115 may switch to a separated state in a case where the temperature of the fixing belt 63 exceeds the first threshold value, and switch to a contact state in a case where the temperature of the fixing belt 63 exceeds the second threshold value, which is higher than the first threshold value.

Alternatively, the moving unit 115 may start warm-up, and switch from a contact state to a separated state after a predetermined period of time has passed. In this case, the predetermined period of time is set in accordance with the rate of temperature rise of the lubricant or the like in a contact state, so that the temperature of the lubricant reaches a target temperature (such as the first threshold value at which the lubricant has an appropriate viscosity) after the predetermined period of time has passed. In this manner, the same effects as those of the above embodiments can also be achieved.

Although embodiments of the present invention have been described and illustrated in detail, the disclosed embodiments are made for purposes of illustration and example only and not limitation. The scope of the present invention should be interpreted by terms of the appended claims. It should be understood that equivalents of the claimed inventions and all modifications thereof are incorporated herein.

What is claimed is:

1. A fixing device that fixes a toner image formed on a paper sheet to the paper sheet, the fixing device comprising:

a pressure roller that applies pressure to the paper sheet; and a heating member that heats the paper sheet, wherein the heating member includes:

a pressure pad positioned to face the pressure roller;

a heating roller including a heater; and a fixing belt wound around the pressure pad and the heating roller in an endless manner, the fixing device further comprises a drive mechanism that controls rotation of the pressure roller and the heating roller, the fixing belt is driven while sliding on a surface of the pressure pad, when the heating roller rotates, and the drive mechanism moves at least one of the pressure roller and the heating member, to apply pressure to the paper sheet being conveyed between the pressure roller and the pressure pad, and fix the toner image to the paper sheet, switches between a contact state in which the pressure roller and the fixing belt are in contact with each other, and a separated state in which the pressure roller and the fixing belt are separated from each other, and switches to the contact state when a predetermined condition is satisfied during a period of warm-up for the heating member, wherein a lubricant is applied to the surface of the pressure pad, and the drive mechanism switches to the separated state when a temperature of the lubricant exceeds a first threshold value during a period of the warm-up, which is a period of the contact state.

2. The fixing device according to claim 1, wherein the predetermined condition is that warm-up for the heating member has been started.

3. The fixing device according to claim 1, wherein, during a period of the warm-up, which is a period of the contact state, the drive mechanism moves the at least one of the pressure roller and the heating member, to reduce a pressure to be generated between the pressure roller and the fixing belt to a lower pressure than a pressure to be generated during a period after the warm-up is completed.

4. The fixing device according to claim 1, wherein, during a period of the warm-up, which is a period of the contact state, the drive mechanism rotates the pressure roller at a lower speed than a speed during a period after the warm-up is completed.

5. The fixing device according to claim 1, wherein the drive mechanism moves the at least one of the pressure roller and the heating member, to adjust a frictional force to be generated between the pressure roller and the fixing belt in the contact state during a period of the warm-up, to a greater frictional force than a frictional force to be generated between the heating roller and the fixing belt by a tension of the fixing belt in the separated state.

6. The fixing device according to claim 1, wherein the pressure roller includes grips at both ends in a rotational axis direction, the grips having a higher friction coefficient than a central portion in the rotational axis direction.

7. The fixing device according to claim 1, wherein, during a period of the warm-up, the drive mechanism switches to the separated state when a predetermined time has passed since switching to the contact state.

8. The fixing device according to claim 1, wherein the drive mechanism switches to the contact state when the temperature of the lubricant exceeds a second threshold value during a period of the warm-up, which is a period of the separated state, the second threshold value being higher than the first threshold value.

9. The fixing device according to claim 1, wherein the drive mechanism switches to the separated state when a temperature of the fixing belt exceeds a first threshold value during a period of the warm-up, which is a period of the contact state.

10. The fixing device according to claim 9, wherein the drive mechanism switches to the contact state when the temperature of the fixing belt exceeds a second threshold value during a period of the warm-up, which is a period of the separated state, the second threshold value being higher than the first threshold value.

11. The fixing device according to claim 1, wherein the predetermined condition is that an amount of work of the fixing device exceeds a predetermined threshold value.

12. The fixing device according to claim 1, wherein a lubricant is applied to the surface of the pressure pad, and the predetermined condition is that at least one of an environmental temperature outside the fixing device, a temperature of the fixing belt, and a temperature of the lubricant is lower than a predetermined threshold value.

13. The fixing device according to claim 12, wherein, the drive mechanism sets the contact state when at least one of the environmental temperature outside the fixing device, the temperature of the fixing belt, and the temperature of the lubricant is lower than the predetermined threshold value at a start of the warm-up, and the drive mechanism sets the separated state when one of the environmental temperature outside the fixing device, the temperature of the fixing belt, and the temperature of the lubricant is not lower than the predetermined threshold value.

14. The fixing device according to claim 1, wherein the drive mechanism sets the separated state at a start of the warm-up, and causes the heater to generate heat after movement of the fixing belt is detected.

15. The fixing device according to claim 1, wherein the drive mechanism sets the separated state at a start of the warm-up, and switches to the contact state when movement of the fixing belt is not detected.

16. An image forming apparatus comprising the fixing device according to claim 1.

17. A method of controlling a fixing device that fixes a toner image formed on a paper sheet to the paper sheet, the fixing device including:

a pressure roller that applies pressure to the paper sheet; and a heating member that heats the paper sheet, the heating member including:

a pressure pad positioned to face the pressure roller;

a heating roller including a heater; and a fixing belt wound around the pressure pad and the heating roller in an endless manner, wherein a lubricant is applied to a surface of the pressure pad on which the fixing belt slides, the control method comprising:

moving at least one of the pressure roller and the heating member, to apply pressure to the paper sheet being conveyed between the pressure roller and the pressure pad, and fix the toner image to the paper sheet;

switching between a contact state in which the pressure roller and the fixing belt are in contact with each other, and a separated state in which the pressure roller and the fixing belt are separated from each other;

switching to the contact state when warm-up for the heating member is started; and switching to the separated state when a temperature of the lubricant exceeds a first threshold value during a period of the warm-up, which is a period of the contact state.

* * * * *